US006170828B1

(12) United States Patent
Mostashari

(10) Patent No.: US 6,170,828 B1
(45) Date of Patent: Jan. 9, 2001

(54) NO BUST 21 (BLACKJACK)

(76) Inventor: Moe Mostashari, 1899 Rancho Hills Dr., Chino Hills, CA (US) 91709

( * ) Notice: Under 35 U.S.C. 154(b), the term of this patent shall be extended for 0 days.

(21) Appl. No.: 09/492,395

(22) Filed: Jan. 27, 2000

(51) Int. Cl.[7] ..... A63F 1/00
(52) U.S. Cl. ..... 273/292; 273/274; 273/139
(58) Field of Search ..... 273/292, 274, 273/139

(56) References Cited

U.S. PATENT DOCUMENTS 5,265,877 * 11/1993 Boylan et al. ..... 273/139
5,275,415 * 1/1994 Wisted ..... 273/274
5,810,360 * 9/1998 Srichayaporn ..... 273/274
5,823,536 * 10/1998 Flasch ..... 273/292
6,027,118 * 2/2000 Aramapakul et al. ..... 273/274

OTHER PUBLICATIONS

Casino Gaming Concepts Inc.—Super Blackjack, 1993.*
Casino Gaming Concepts Inc.—21st century Blackjack, 1994.*

* cited by examiner

*Primary Examiner*—Jeanette Chapman
*Assistant Examiner*—Dolores R. Collins
(74) *Attorney, Agent, or Firm*—Leonard Weiss

(57) ABSTRACT

A variation of blackjack is played with a standard deck of cards that is augmented by two jokers. A hand that includes the two jokers is called a natural. The natural outranks all other hands. A hand that includes one joker has a total point value of "21". The player is permitted to hit, double-down, surrender or split a pair unless a face-up card of the dealer is a joker.

4 Claims, 3 Drawing Sheets

NO BUST 21 (BLACKJACK)

BACKGROUND OF THE INVENTION

1. Field of Invention

This invention is in the general field of casino gaming and, more particularly, is a variation of the game of blackjack.

2. Description of the Prior Art

Blackjack is a game played at a semicircular table with seven player stations equally spaced on the table's top near an arcuate edge thereof. There is an imprint of a circle at each player station. A player places cheques representative of a wager within the circle. A dealer is positioned near a straight edge of the table. The dealer faces the player.

Blackjack is played with one or more standard decks of cards. An ace dealt to a player has a point value of either "1" or "11" at the election of the player; a face card (jack, queen or king) has a point value of "10" and each of the remaining cards ("2" through "10") have a point value equal to what is alternatively referred to as a "pip" value or a number value of the card. Point values of cards held by the player are added together to obtain a player total point value. A dealer total point value is obtained in a similar manner.

After the cheques are placed within the imprinted circle, the cards are shuffled and the player and the dealer are each dealt a hand comprised of two cards. The cards of the player's hand are dealt face-up. A first card of the dealer's hand is dealt face-down. A second one of the dealer's hand is dealt face-up.

Whenever the dealer face-up card is either an ace or has a point value of "10", the dealer ascertains the point value of the face-down card without revealing it to the player unless the dealer total point value is "21". When the two cards of the dealer hand cause the dealer total point value to be "21", the dealer is said to have blackjack whereupon the dealer turns the face-down card face up. Similarly, when the two cards of the player hand causes the player total point value to be "21", the player is said to have blackjack.

When the dealer has blackjack, the dealer wins the wager with two exceptions. A first exception occurs when the dealer's face up card is an ace and the player posts cheques representative of what is known as an insurance bet which is typically equal to one half of the wager. When the dealer does not have blackjack, the player loses the insurance bet. When the dealer has blackjack, the cheques representative of the wager and the insurance bet are returned to the player.

The second exception occurs when the player has blackjack whereupon the cheques representative of the wager are returned to the player. The second exception is an example of when the player hand and the dealer hand have the same total point value and is referred to as a push.

When the player has blackjack and the dealer does not, the player wins the wager. When neither the dealer nor the player have blackjack, the player has four options.

A first option is to have the player hand augmented by an additional card (referred to as a "hit") . The player may have successive hits until the player total point value exceeds "21". When the total point value of a hand exceeds "21" it is said to bust. The player loses the wager when the player hand busts. Therefore, busting is a sudden, catastrophic termination of play for the player.

A second option is not to have the player hand augmented by the additional card (referred to as a "stand"). The player may stand at any time that the player hand has not busted.

A third option, referred to as doubling down, permits the player to double the wager and receive one additional card.

A fourth option is available when the player hand is comprised of two cards that are a pair, such as a pair of queens, for example. The player may split the pair into first and second player hands. An additional card is dealt to the first player hand and to the second player hand, each of which are played as described hereinbefore.

The decision to hit or stand is made with an objective of causing the player total point value to be closer to "21" than the dealer total point value without busting. It should be understood that central factors in making the decision are the dealer's faceup card and the player total point value.

After the player stands, the dealer's face-down card is turned face-up, whereby both cards of the dealer hand are face-up. When the dealer total point value is less than "17" the dealer must hit until the dealer total point value is at least "17". When a hit causes the dealer hand to bust and the player hand has not busted, the player wins the wager.

It should be understood that when an exemplary hand includes an ace and a six, for example, it is referred to as a soft "17" because the ace causes the exemplary hand to have alternative point values of "7" and "17". Usually, the dealer hand cannot be hit when it is the soft "17".

When neither the player hand nor the dealer hand busts and the dealer total point value exceeds the player total point value, the dealer wins and vice versa. When there is a push, there is no winner; the cheques representative of the wager are returned to the player.

A desirable aspect of blackjack is its simplicity. However, is blackjack can be made more interesting by providing play that requires an inclusion of jokers in the decks of cards and by providing play instead of the bust when the player point value exceeds "21". The inclusion of the jokers and providing play when the player point value exceeds "21" need not be a compromise of simplicity.

SUMMARY OF THE INVENTION

According to the present invention, NO BUST 21 (BLACKJACK) is a game that utilizes a standard deck of cards augmented by two or more jokers. A player and a dealer are each dealt a hand of two cards. One of the dealer's cards is dealt face-up; the other is dealt face down. A natural is a hand that consists of the two jokers. The natural outranks all other hands. A hand has a total point value of "21" when it includes a joker. The player may hit, double-down, split a pair or surrender to acquire a final player hand when the dealer's face-up card is not a joker. When a dealer hand has a total point value that is a soft "17" or less, a dealer must take a hit to acquire a final dealer hand. When the final player hand and the final dealer hand have total point values that are greater than "21" and the player point value is less than or equal to the dealer point value, it is regarded as a push. When the total point values are each greater than "21", with the dealer point value being closer to "21" than the player point value, the player loses.

Other objects, features, and advantages of the invention should be apparent from the following description of the preferred embodiment thereof as illustrated in the accompanying drawing.

DESCRIPTION OF THE PREFERRED EMBODIMENT

NO BUST 21 (BLACKJACK) is a game that is played with one or more standard decks of cards, each of which is augmented by two jokers. As in most blackjack games, cheques representative of a wager are posted by a player before cards are dealt. Thereafter, the player is dealt two cards face-up. A dealer is dealt one card face up and one card face-down.

Figure 1:
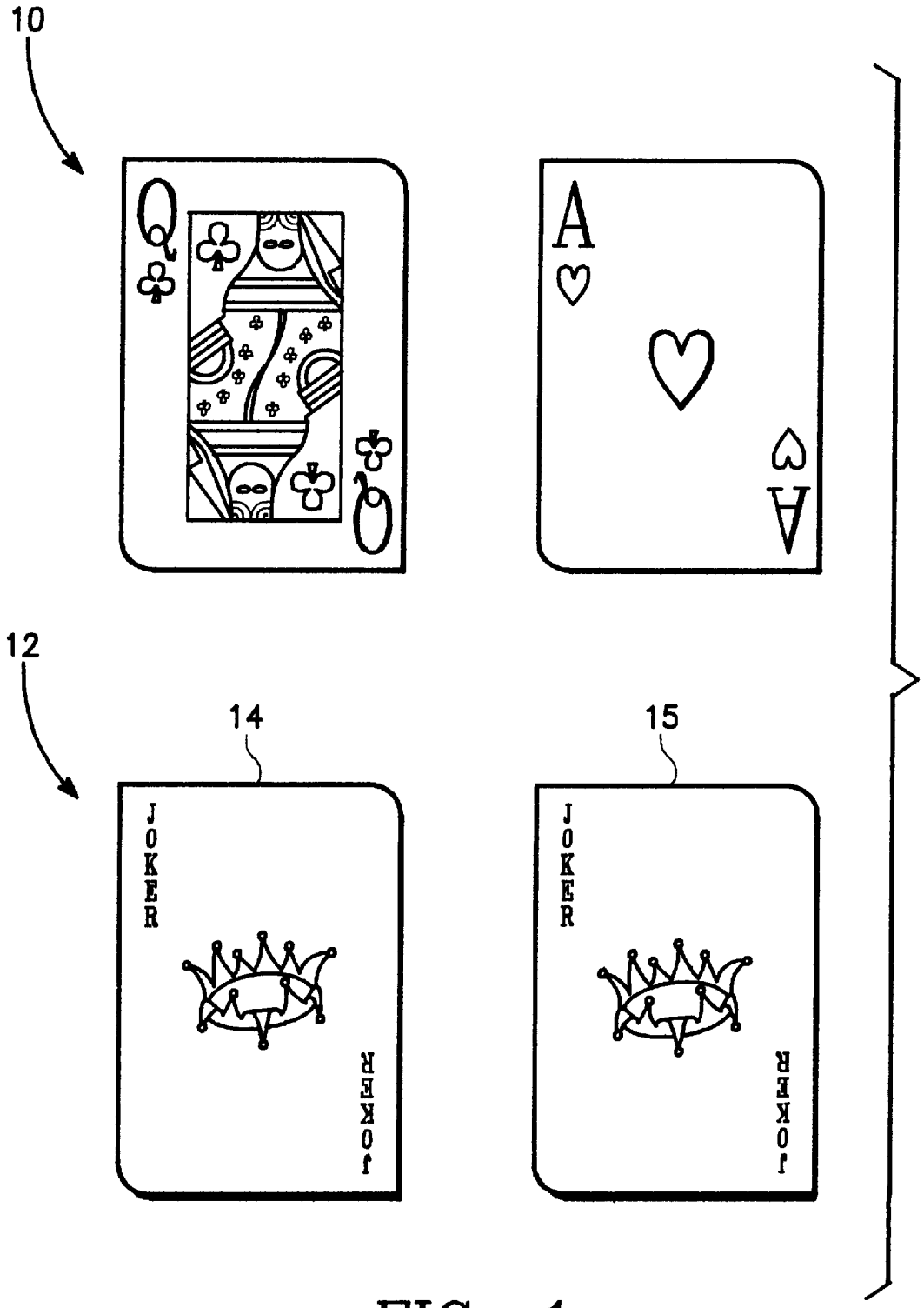
FIG. 1 is a plan view of hands of cards dealt in a game of NO BUST 21 (BLACKJACK) where one hand of cards is a blackjack and another hand of cards is a natural.

As shown in FIG. 1, a final hand 10 includes an A♥ and a Q♣. A final hand 12 includes jokers 14, 15. The hand 12 is known as a natural. The natural outranks all other hands. Hence, although the hand 10 has a total point value of "21", it is outranked by the hand 12. Therefore, when a dealer is dealt the hand 10 and the player is dealt the hand 12, the player wins and vice versa.

In this embodiment, when the player wins with the natural, the player is awarded a two to one payout. All other payouts to the player are one to one. A push occurs when the player and the dealer both have the natural, thereby obviating a payout.

When a hand includes two or more cards with one of the cards being a joker, the hand is final and has a total point value of "21". However, whenever the initially dealt face-up card of the dealer hand is not a joker, the dealer's face-down card is not turned face up until the player is permitted to alternatively hit, stand, double-down or split a pair as in the prior art. Conversely, the player and dealer hands become final when the face-up card of the dealer hand is a joker; the dealer face-down card is turned face-up and the dealer and player hands are compared to determine whether there is a winner or a push.

Figure 2:
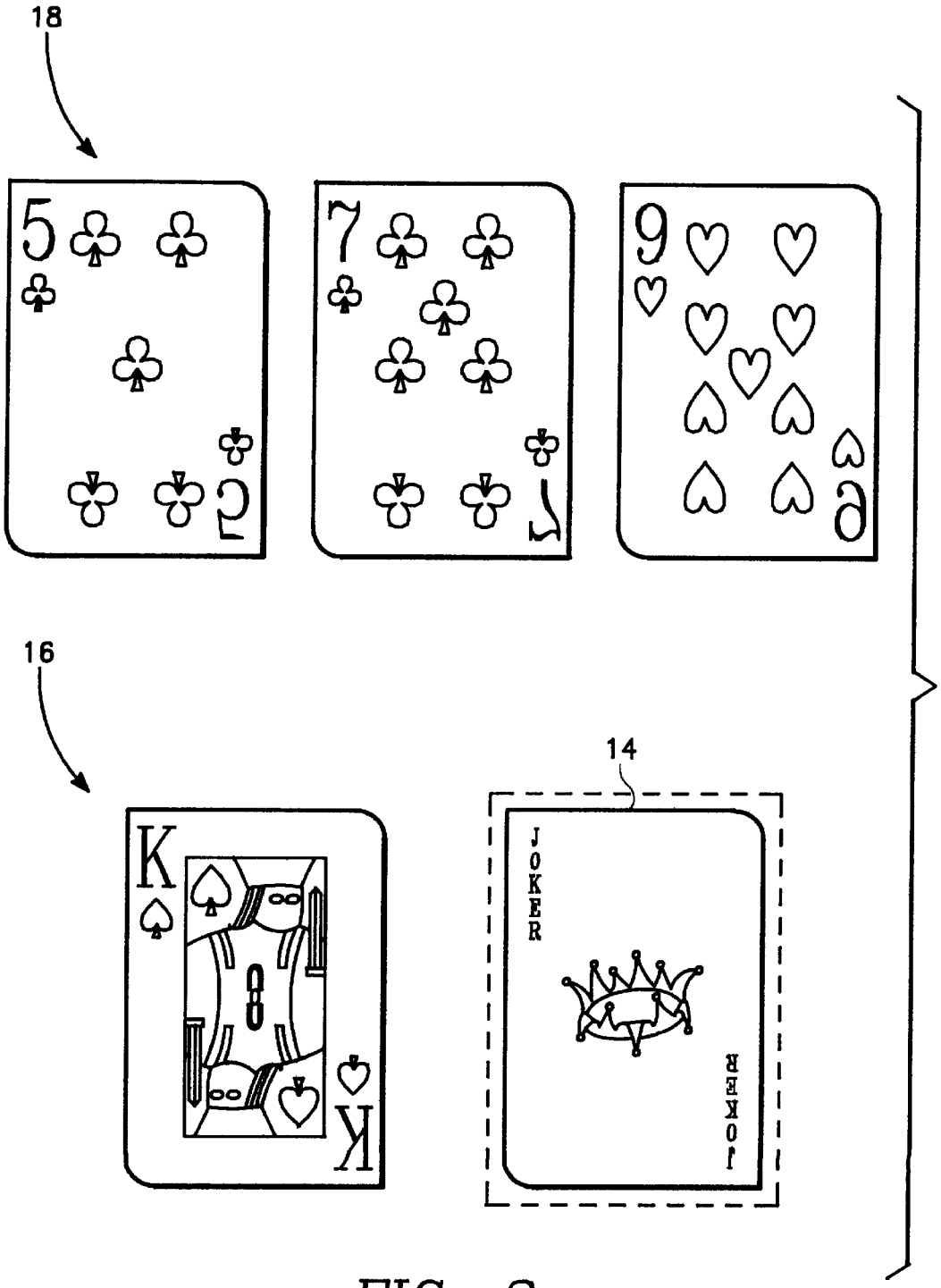
FIG. 2 is a plan view of hands of cards dealt in a game of NO BUST 21 (BLACKJACK) where one hand of cards is a blackjack and another hand has a total point value of "21"

As shown in FIG. 2, a dealer hand 16 includes a K♠ that is face-up and the joker 14 that is face-down. A final player hand 18 includes a 5♣, a 7♣ and a 9♥, whereby the hand 18 has a total point value of "21". When the player stands, the joker 14 is turned face-up, thereby revealing that the hand 16 is final and has a total point count of "21". Since the hands 16, 18 both have the total point count of "21", there is a push: the player retrieves the cheques representative of the wager.

Figure 3:
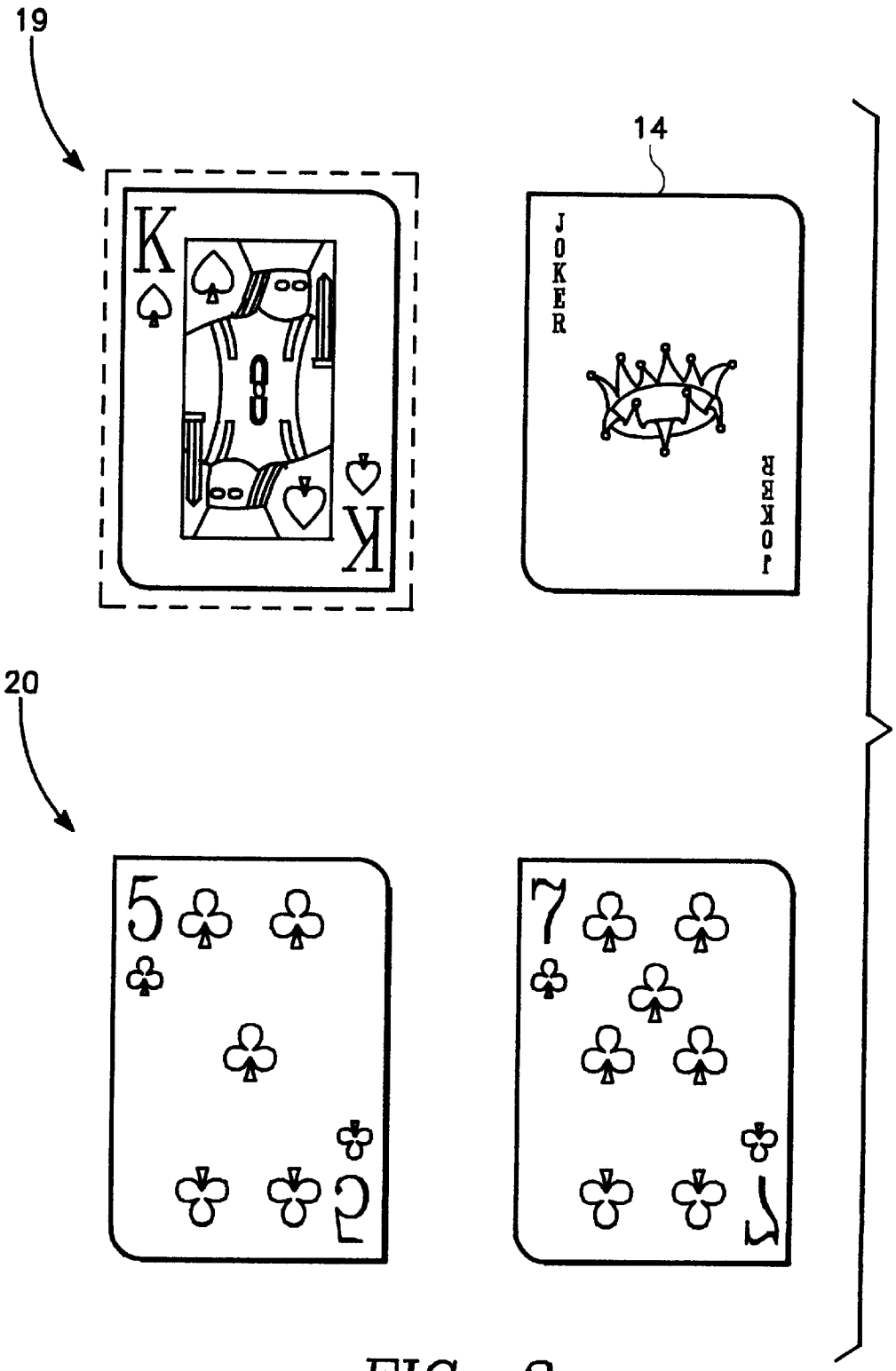
FIG. 3 is a plan view of a dealer's hand that includes a joker as a face-up card and a player's hand has a total point value of "12".

As shown in FIG. 3, a dealer hand 19 includes a K♠. that is face-down and the joker 14 that is face-up. A player hand 20 includes a 5♣ and a 7♣ whereby the player hand 20 has a total point value of "12". Since the face-up card of the dealer hand 19 is the joker, the hands 19, 20 are final and play is at an end. Because the dealer hand 19 is known to be either a natural or blackjack, and the total point value of the player hand is "12", the player loses.

In NO BUST 21 (BLACKJACK), when the dealer point value is a soft "17" or less, the dealer hand must take a hit. Additionally, when the player hand busts and the dealer hand does not bust, the player wins and vice versa.

When the dealer and the player total point values are both greater than "21", there are two possible outcomes. A first outcome is the player losing the wager when the dealer total point value is closer to "21" than the total player point value. A second outcome is the player recovering the wager, as in a push, when the player total point value is less than or equal to the dealer total point value. Alternatively, the player loses the wager when the dealer and the player total point values are equal.

In NO BUST 21 (BLACKJACK) there is a surrender option available to the player prior to the first two cards of the player hand being augmented by another card. The surrender option is not available when an initially dealt face-up card of a dealer hand is a joker. By surrendering, the player retrieves one half of the wager.

I claim:

1. In a NO BUST 21 (BLACKJACK) game played with a standard deck of cards where cards are dealt after a player posts a wager, two cards of a player hand being dealt to the player and two cards of a dealer hand being dealt to a dealer with one of the dealer cards being dealt face-down and the other being dealt faceup, the improvement comprising the steps of:

augmenting the deck with at least two jokers;

permitting the player to hit, double-down or split a pair to acquire a final player hand when the face-up card of the dealer hand is not a joker;

dealing an additional card to the dealer hand when the dealer hand total point value is a soft "17" or less whereby the dealer acquires a final dealer hand;

defining a hand of two or more cards as having a total point value of "21" when one of said cards is a joker;

defining a natural as two jokers in a hand, said natural outranking all other hands; and permitting the player to surrender and recover a portion of the wager when the face-up card of the dealer hand is not a joker.

2. In the game of claim 1 including the steps of:

comparing the final player hand to the final dealer hand; and making a payout to the player when the player hand outranks the final dealer hand.

3. In the method of claim 1 including the step of the player recovering said wager when the dealer and player final hands each have total point values that are greater than "21" and said player total point value is less than or equal to said dealer total point value.

4. In the method of claim 1 including the step of the player recovering said wager when the dealer and player final hands each have total point values that are greater than "21" and said player total point value is less than said dealer total point value.

* * * * *